United States Patent [19]

Buisine et al.

[11] Patent Number: 4,705,459

[45] Date of Patent: Nov. 10, 1987

[54] METHOD OF OBSERVING THE PUMPING CHARACTERISTICS OF A POSITIVE DISPLACEMENT PUMP

[75] Inventors: Paul H. Buisine, La Fouillouse; Paul Dancer, St. Etienne, both of France

[73] Assignee: Dowell Schlumberger Incorporated, Tulsa, Okla.

[21] Appl. No.: 767,001

[22] Filed: Aug. 19, 1985

[30] Foreign Application Priority Data

Nov. 15, 1984 [FR] France ..... 84 17447

[51] Int. Cl.[4] ..... F04B 51/00

[52] U.S. Cl. ..... 417/53; 417/63; 73/168; 137/554

[58] Field of Search ..... 417/53, 63, 572; 92/5 R; 73/168; 137/554, 551

[56] References Cited

U.S. PATENT DOCUMENTS

| | | | |
|---|---|---|---|
| 3,677,092 | 7/1972 | Guarino | 417/63 X |
| 3,872,723 | 3/1975 | Busch | 73/168 |
| 3,921,435 | 11/1975 | Howard | 73/168 X |
| 3,942,375 | 3/1976 | Shepherd | 73/168 |
| 3,957,395 | 5/1976 | Ensign | 417/53 X |
| 4,129,037 | 12/1978 | Toalson | 73/151 |
| 4,171,185 | 10/1979 | Duke et al. | 417/36 X |
| 4,255,088 | 3/1981 | Newton et al. | 417/1 |
| 4,352,636 | 10/1982 | Patterson et al. | 417/53 X |
| 4,523,286 | 6/1985 | Koga et al. | 137/551 X |
| 4,542,649 | 9/1985 | Charbonneau et al. | 73/168 |

FOREIGN PATENT DOCUMENTS

| | | | |
|---|---|---|---|
| 1002141 | 2/1957 | Fed. Rep. of Germany | 73/168 |
| 31573 | 3/1981 | Japan | 137/551 |

OTHER PUBLICATIONS

"Know Your Triplex Mud Pump" from *World Oil*, by S. L. Collier, Part 2, Jan. 1982, pp. 139–144; Part 3, Feb. 1, 1982, pp. 87–93; Part 4, Mar. 1982, pp. 113–118; Part 5, Apr. 1982, pp. 109–114; Part 6, May 1982, pp. 219–234; Part 7, Jun. 1982, pp. 241–246.

*Primary Examiner*—Carlton R. Croyle
*Assistant Examiner*—Paul F. Neils
*Attorney, Agent, or Firm*—L. Wayne White

[57] ABSTRACT

The invention relates in particular to measuring the delivery rate of a positive displacement pump comprising at least one piston (3) driven with reciprocating movement in a chamber (2), which chamber is connected to an inlet circuit (4) via an inlet valve (5) and to an outlet circuit (6) via a delivery valve (7). The number of cycles performed by the pump in unit time are counted, and simultaneously its volumetric efficiency is measured, thereby enabling its real delivery rate to be deduced. Its volumetric efficiency may be measured by means of position sensors (17, 18) detecting the closure and opening instants of the delivery valve, with another sensor determining the instants at which the piston (3) passes through its end positions.

9 Claims, 5 Drawing Figures

METHOD OF OBSERVING THE PUMPING CHARACTERISTICS OF A POSITIVE DISPLACEMENT PUMP

The invention relates to a method of observing the pumping characteristics such as the volumetric efficiency, and more particularly the delivery rate and delivered volume, of a positive displacement pump which comprises at least one piston driven with reciprocating motion in a chamber, which chamber is connected to a feed circuit for the fluid to be pumped via an inlet valve and to an outlet circuit via a delivery valve, said valves being mechanically independent from the piston.

The delivery rate of a positive displacement pump is theoretically equal to the product of the volume swept by the piston and the number of cycles performed by the piston in unit time. However the real delivery rate is different from the value calculated in this manner since, in practice, the volumetric efficiency of the pump is not equal to 100%, but to some smaller value which is not known exactly, and which varies as a function of the number of cycles per unit time and of the operating conditions.

The term "volumetric efficiency" of the pump under its installation conditions and at its operating speed is used to denote the ratio between the volume of high pressure fluid delivered to the outlet circuit divided by the total volume swept by the pistons.

The rate of the pump is the rate at which it delivers fluid, unless the "suction rate" is specified. The delivery rate and the suction rate differ by virtue of the compressibility of the fluid and of any leaks there may be from the pump.

Because of inadequate knowledge of the volumetric efficiency, delivery rate measurements are generally performed by means of a flow meter connected in series with the pump. This solution has the drawback of requiring the flow meter to be changed when it is desired to pump another fluid having other properties, since conventional flow meters are not suitable for use with a wide range of fluids. Unfortunately, fluids that require pumping are, in practice, of widely differing natures. The fluids may be corrosive liquids, viscous liquids, insulating liquids, liquids containing solids, etc.

The object of the present invention is to enable at least one pumping characteristic to be determined while such a pump is in operation, and in particular to perform delivery rate measurements directly on the pump itself, thereby avoiding the use of external apparatuses.

Generally speaking, the method in accordance with the invention consists in fitting the pump with means enabling the positions of at least one of its moving members to be determined as a function of time, said members including one valve and one or more pistons, the method then consisting in analyzing the signals delivered by said means. Advantageously, the positions (and in particular the end positions) of the piston or of one of the pistons, and the opening and/or closure instants of at least one of the valves are detected as a function of time. The means used may be chosen from the group constituted by: acoustic sensors, accelerometer sensors, position sensors, proximity sensors, pressure sensors, deformation sensors, and force sensors.

More particularly, the method may consist in determining at least the time difference between the closure and/or opening instants of at least one of the said valves and the instants at which the said piston passes through its end positions corresponding to the dead points, and calculating from the piston movement, the corresponding volumetric efficiency.

When the characteristic to be determined is the pump delivery rate in operation, the method consists essentially in counting the number of cycles performed by the pump in unit time, in simultaneously measuring the volumetric efficiency of the pump, which efficiency is deduced from the said determination of at least one time difference, and in calculating the delivery rate by multiplying the said number of cycles per unit time and the volume of the chamber as corrected by the measured volumetric efficiency.

The value of the volumetric efficiency to be determined by this method depends on the ratio between the theoretical operation and the real operation of the pump.

The theoretical operating principle of a positive displacement pump is known. The reciprocating motion of a piston expels fluid contained in the chamber to the outlet circuit and then sucks fluid from the inlet circuit into the chamber. Under ideal conditions, the inlet and delivery valves close instantly when the motion of the piston reverses, and the entire volume swept by the piston is delivered to the delivery circuit, giving an efficiency of 100%.

However, real operating conditions are different from such ideal conditions, in particular due to the closure delay of the valve.

While the piston moves out from the chamber, the inlet valve is open and the delivery valve is closed. At the end of its stroke, the piston stops and its motion is reversed. At this instant, the valves ought to swap their positions instantaneously. However, they have a degree of inertia and their motion through the fluid medium is not friction-free. Despite the return spring provided, the inlet valve does not close instantaneously and a certain volume of fluid is delivered to the inlet circuit. This volume is a lost volume which reduces the volumetric efficiency of the pump.

Further, once the inlet valve has closed, the delivery valve does not open instantaneously. The fluid must initially be raised to a pressure which is slightly higher than the delivery pressure. It is therefore necessary to compress the fluid contained in the chamber as a whole, and not just the volume swept by the piston. It may be necessary to deform the seals and the piston gaskets, and to top up any leaks. A certain volume is thus lost and the volumetric efficiency is further reduced.

Likewise, when the piston moves into the chamber and expels the fluid to the outlet circuits, the delivery valve is opened and the inlet valve is closed. At the end of its stroke, the piston stops before moving away in the opposite direction. The delivery valve does not close instantaneously, and a certain quantity of fluid is sucked back from the outlet circuit into the chamber. This volume is a further lost volume which contributes to reducing to the volumetric efficiency of the pump.

It is then necessary to decompress the fluid present in the chamber and maybe to move the seals or to enable the pump to regain its shape (mechanical breathing) before the inlet valve can open. The pressure to be reached should be slightly less than the pressure present on the other side of the valve prior to the valve opening. Depending on how the fluid is brought to the inlet, this pressure may be less than the vapor pressure of the fluid under pumping conditions. This results in cavitation and hammering.

By permanently monitoring the closure and/or opening instants of the valves together with the position of the piston, it is possible to accurately calculate the quantities of fluid which are lost and to deduce the volumetric efficiency of the pump.

Then, in accordance with the invention, the volumetric efficiency may be determined by measuring the partial volumes of the chamber swept by the piston firstly between the instant at which the piston passes through its position of maximum insertion in the chamber and the instant at which the delivery valve closes, and secondly between the instant at which the piston passes through its opposite end position and the instant at which the delivery valve opens. The corrected volume is then determined by subtracting these two partial volumes from the volume of the chamber. The flow rate delivered by the pump can be calculated by counting the number of cycles performed by the pump in a unit of time, and multiplying this figure by the corrected volume.

The instants at which the piston passes through its end positions may be determined by measuring the varying positions of the piston as a function of time by means of a displacement sensor. If the motion of the piston is symmetrical relative to its end positions, the said instants may alternatively be determined as being equidistant between the successive instants at which the piston passes through a predetermined position, said instants corresponding, for example, to an element fixed to the piston passing in front of a fixed proximity detector.

Further, the instants at which the valves close or open may be determined in various ways: either directly, e.g. by detecting the shocks they produce when closing against their seats, or by acoustically detecting the noise of fluid escaping between each valve and its seat, or else by measuring the positions of the valves as they vary as a function of time relative to their respective seats.

The closure and opening instants of the valves may alternatively be determined indirectly by measuring pressures whose variations as a function of time indicate said instants. The pressure may be the pressure inside the pump chamber and/or in the pump outlet circuit.

It is possible to obtain indications on the compressibility of the fluid by observing the rising or falling slope of the pressure in the chamber. When the piston begins to advance into the chamber, the pressure exerted on the fluid increases. The delivery valve does not open until the force exerted thereon by the internal pressure in the chamber exceeds the force exerted by the pressure in the outlet circuit and by the valve return spring. The pressure increase in the chamber depends on the compressibility of the fluid. If the fluid is compressible the piston must cover a certain distance before the pressure in the chamber is brought to the same pressure as the outlet circuit plus the pressure due to the spring. The corresponding volume is a lost volume which reduces the volumetric efficiency of the pump. The compressibility of the fluid can be calculated by observing the speed at which the pressure in the chamber rises. In the same manner, when the pressure drops, the fluid reduces in pressure and the compressibility of the fluid can be measured a second time. In addition, an excessively long opening period for the delivery valve due to an abnormally long increase in pressure for a given fluid may indicate the presence of bubbles of gas in the pumped fluid.

Similar effects may be produced by mechanical deformations of the pump structure, by the valves being pressed into their seats, by deformation in the piston sealing system, and by leaks, if any.

Some of the measurements performed in accordance with the method of the invention for determining the volumetric efficiency of a pump, for example, and hence the delivery rate thereof, may also show up faults affecting the operation thereof. Thus an excessively long valve closure time at a given speed of pump operation may indicate a defect in the corresponding return spring. Further, by observing the change of pressure or by listening acoustically it is possible to detect valve leaks due to the presence of solid particles on the valve seat or to deterioration of the seal or of the seat due to erosion.

Thus, by providing a means for determining a corrected volume of a positive displacement pump in real time, the method in accordance with the invention makes it possible to measure the real delivery rate of the pump and also to detect possible faults in the operation thereof.

Other characteristics and advantages of the invention will appear more clearly from the following description given with reference to the accompanying drawings showing non-limiting embodiments.

FIG. 1 relates to the beginning of the suction phase and FIG. 2 to the beginning of the delivery phase of the pump.

Figure 1:
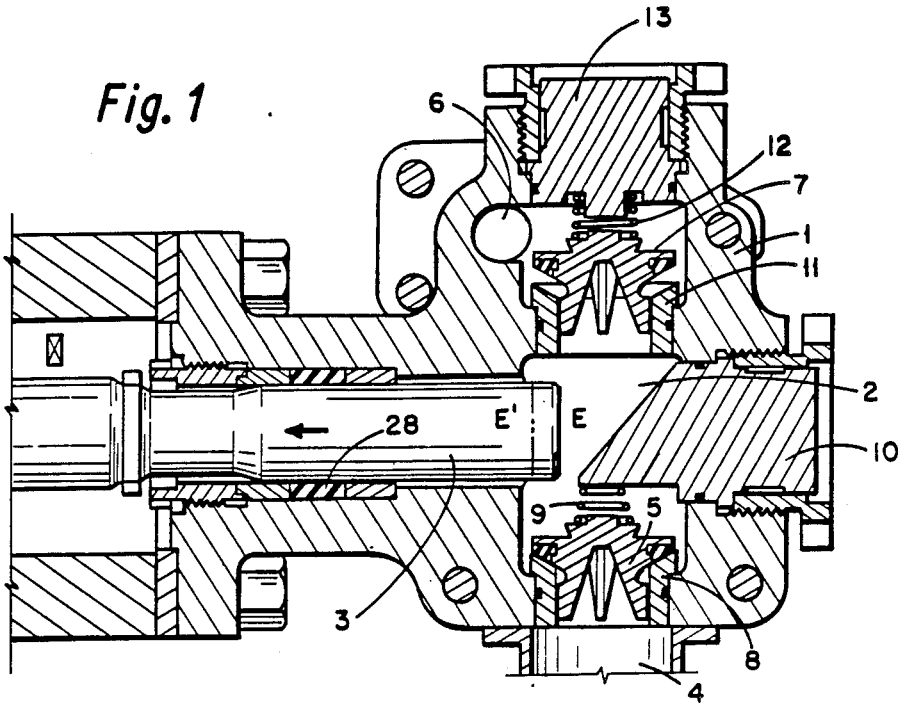
FIGS. 1 and 2 are sections through a positive displacement pump for explaining the principle of the flow rate measuring method in accordance with the invention.
Figure 2:
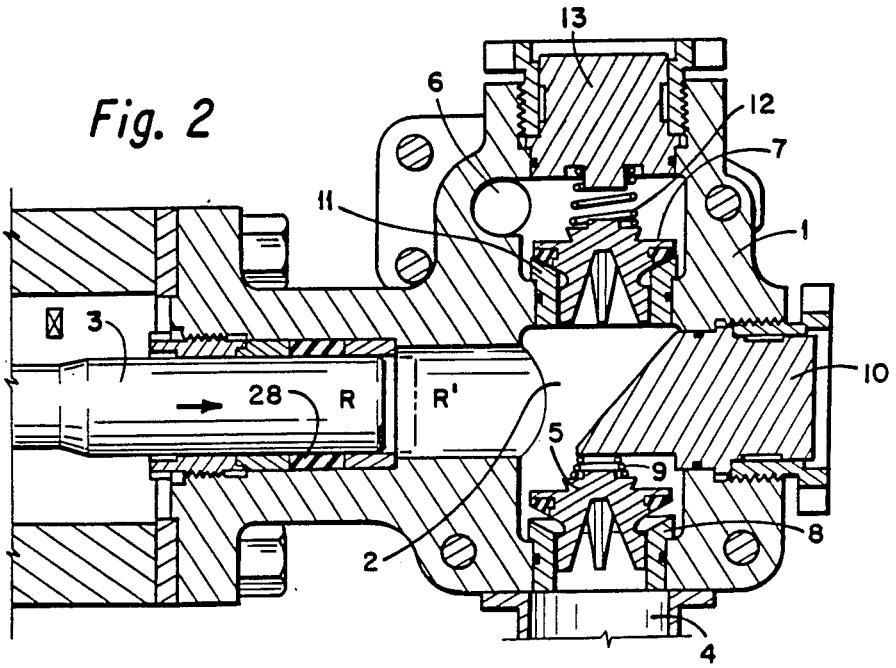

The pump shown in FIGS. 1 and 2 comprises a body 1 delimiting a chamber 2 containing a moveable piston 3 driven in reciprocating motion by a motor (not shown). Sealing is provided by gaskets 28. The chamber is connected to an inlet tube via an inlet valve 5 and to an outlet tube 6 via a delivery valve 7. The inlet valve 5 is urged towards a matching fixed seat 8 by a return spring 9 which bears against a part 10 which is fixed to the body 1. Likewise, the delivery valve 7 is urged against a matching fixed seat 11 by a return spring 12 which bears against a part 13 which is fixed to the body 1.

When the piston 3 moves out from the chamber 2 starting from its maximally engaged end position (see FIG. 1), the pressure reduction caused therein opens the inlet valve 5, while the delivery valve 7 is closed under the combined action of its return spring 12 and of the fluid being sucked back from the outlet circuit of the chamber 2. The fluid to be pumped arrives via the inlet tube 4 and enters the chamber 2 so as to fill it. Then, once the piston 3 has reacbed its other end position corresponding to its maximum removal from the chamber 2 (FIG. 2), it moves back into the chamber forcing the delivery valve 7 to open while the inlet valve 5 closes under the combined action of its return spring 9 and of the fluid delivered from the chamber towards to the inlet circuit. A volume of fluid corresponding to the total volume swept by the piston 3 in the chamber 2 is thus delivered to the outlet tube 6.

In practice, these two volumes are not exactly equal. This happens because when the piston 3 begins to move away from its fully engaged position E, the delivery valve 7 does not close instantaneously, but only after the piston has reached a position E', such that a small volume of fluid corresponding to the volume swept by the piston to its positions E and E' is sucked from the outlet tube 6. Likewise, at the beginning of the movement of the piston from its other end position R, the inlet valve is not yet closed. The inlet valve does not close until the piston has reached a position R', and another small volume of fluid, which is generally larger than the preceding small volume, is wrongly delivered into the inlet tube 4.

Figure 3:
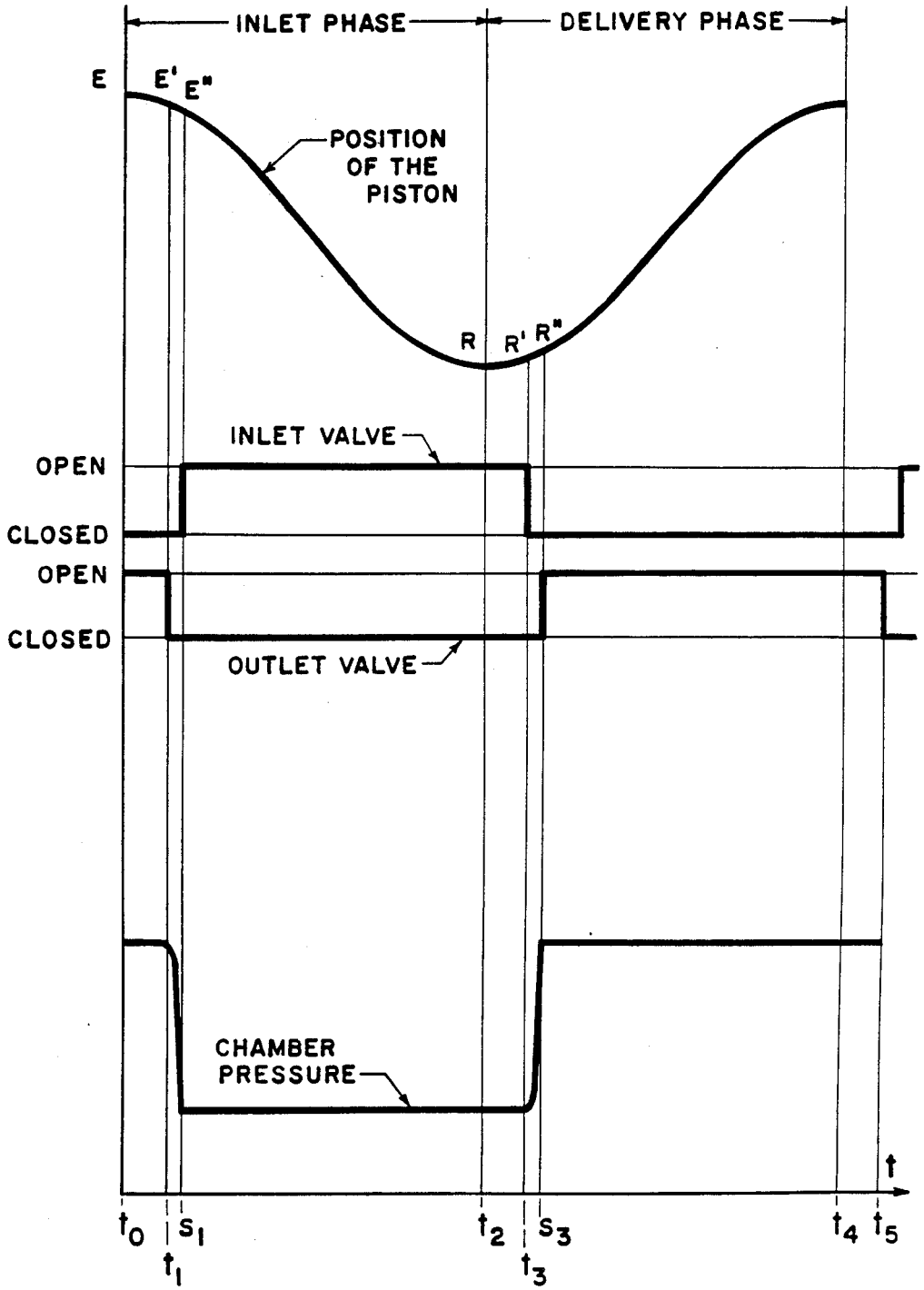
FIG. 3 is a graph showing the principle of the method in accordance with the invention.

These phenomena are shown in FIG. 3 which further includes the instants s1, s3, . . . at which the valves 5 and 7 open, which instants correspond to positions E" and R" of the piston 3. It can be seen in particular, that during the delivery phases, the pressure in the chamber 2 does not take up its high value until after the inlet valve has closed at instant t3, i.e. at the instant s3 when the delivery valve opens, and the pressure remains high until the delivery valve closes at instant t5.

By detecting the instants t1 and s3 at which the delivery valve closes and opens late relative to the theoretical instants t0 and t2, and more precisely by measuring the time intervals t1−t0 and s3−t2 it is possible to calculate the real volume of fluid delivered at each pump cycle, by determining the volumetric efficiency of each pump cycle and then deducing the delivery flow rate by taking account of the number of cycles performed per unit time.

Figure 4:
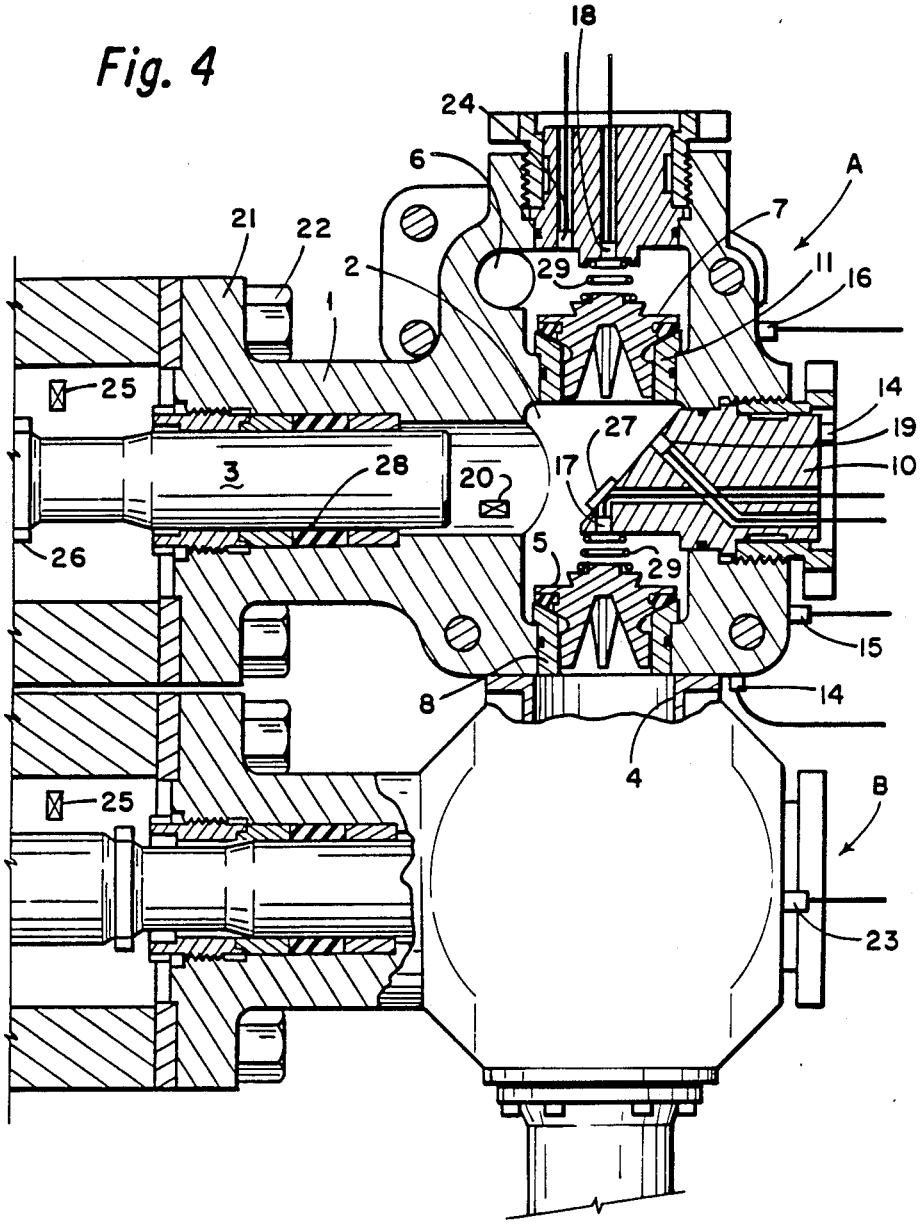
FIG. 4 is a section through a pump fitted with sensors enabling the method in accordance with the invention to be performed.

The instants at which the valves close t1, t3, t5, . . . and/or open s1, s3, s5, . . . may be determined by various means such as those shown in FIG. 4. It is possible to take advantage directly of the movement of the valves, by:

one or more accelerometer sensors 14 which are fixed at appropriate locations on the pump body 1 to detect the shocks created by the valves 5 and 7 as they close against their respective seats 8 and 11;

acoustic sensors 15 and 16 likewise fixed to the body 1 and disposed close to corresponding ones of the valves 5 and 7, said sensors being sensitive to the turbulence noise made by the fluid escaping through the valves, which noise ceases at the moment the valves close;

position sensors 17 and 18 determining the respective displacements of the valves 5 and 7 relative to their fixed seats 8 and 11, and indicating the instants at which these valves close (and also the instants at which they open), which sensors could be ultrasonic sensors or eddy current sensors; and/or strain gauges 29, glued to the springs 9 and 12 to indicate the position of valves on the basis of the degree to which the springs are compressed.

It is also possible to determine the said instants from the various pressures within the pump, by detecting the variations in pressure which are related to the movement of the valves. To this end, the following may be taken into account:

the internal pressure in the pump chamber 2, which pressure may be measured either directly by means of a pressure sensor 19 mounted, for example, in the part 10, or indirectly by means of a strain gauge 20 mounted on the outside of the body 1, or by means of a force sensor 21 mounted between the body 1 and one of its fixing bolts 22;

the inlet pressure as measured by means of a pressure sensor 23 placed in the pump inlet circuit; and/or the delivery pressure measured by means of a pressure sensor 24 placed in a pump outlet circuit.

Appropriate sensors are selected from those mentioned above, depending on the type of measurement which it is desired to perform. In addition, a temperature sensor 27 may be provided in the chamber 2.

The instants t0, t2, t4, . . . at which the piston 3 is occupying one of its end positions are determined in the present example by means of a proximity detector 25 which is fixed relative to the body 1 and which is sensitive to a ring 26 fixed on the piston 3 coming close thereto. The instants to be determined are located in the centers of the time intervals separating the successive passes of the ring 26 past the sensor 25.

The pump shown in FIG. 4 is a multiple unit including a plurality of identical sections A, B, . . . each of which is fitted with sensors such as described above for determining the volumetric efficiency of each section.

Figure 5:
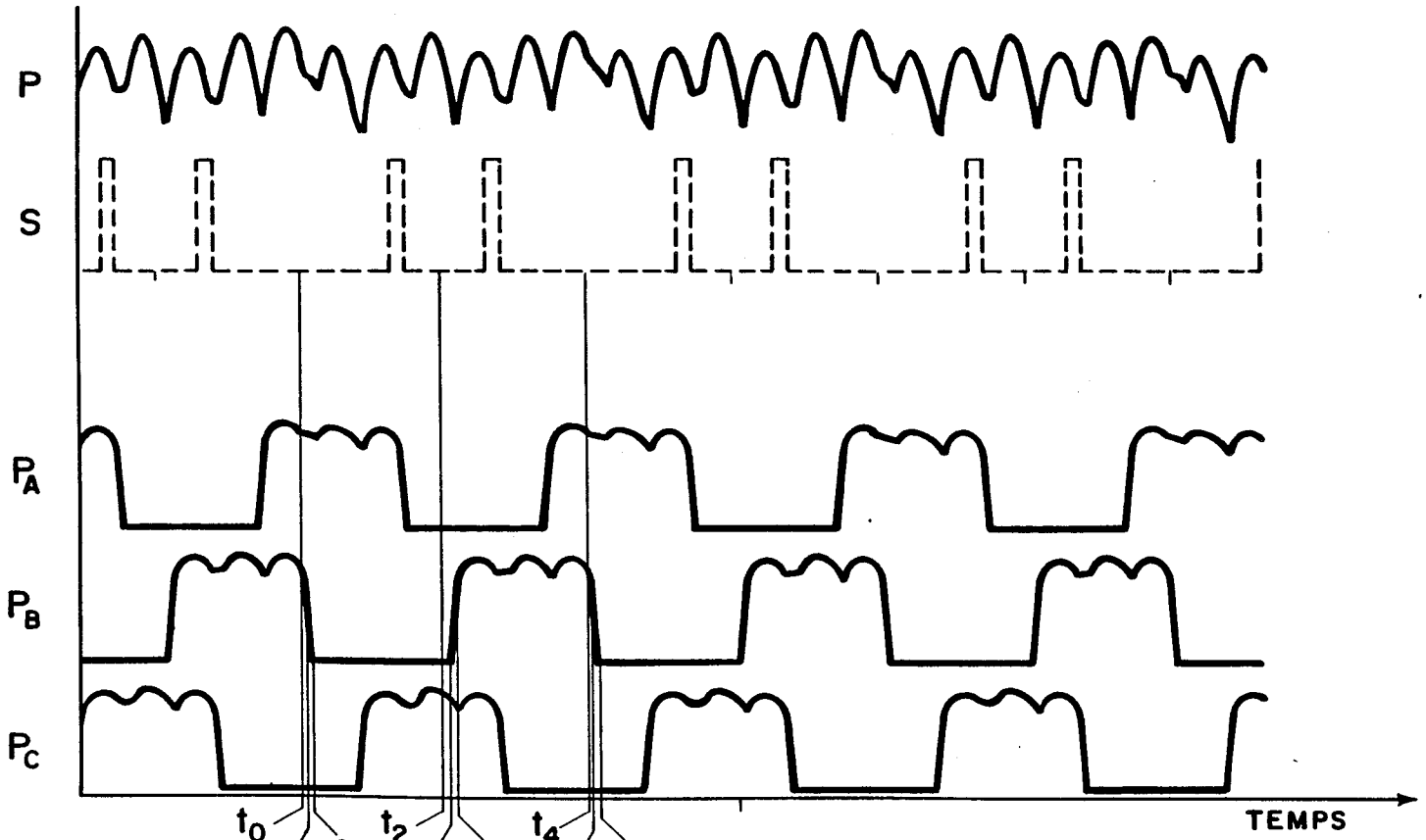
FIG. 5 shows a practical example of pressure curves taken from a triplex pump.

During tests performed on a triplex pump having three sections A, B and C, the pressure curves $P_A$, $P_B$ and $P_C$ shown in FIG. 5 were obtained. These curves show the pressure variations in each of the three chambers, and a curve P shows the pressure variations at the outlet from the pump. The curve P has six bumps per pump cycle. A dashed curve S shows the pulses supplied by the sensor 25 in the section B, from which the instants t0, t2, t4, . . . at which the corresponding piston passes through its end points E and R are deduced. The instants at which the valves in the same section B close t1, t2, t3, . . . and open s1, s3, s5, . . . as marked by the corners in the pressure curve $P_B$ are also marked on the figure. The offsets of the opening and closing instants of the delivery valves relative to the instants t0, t2, t4, . . . serve to calculate the volumetric efficiency of the said section. By proceding in the same manner for the other two sections A and C, it is possible to determine the overall volumetric efficiency of the pump, and hence its delivery rate. In such a pump, a single proximity sensor 25 is generally adequate.

More generally, the analysis of the signals delivered by the various sensors (and particularly, but not exclusively, recognizing the shapes of one or more pressure curves such as those shown in FIG. 5) makes it possible to determine all the characteristics of the pump in operation and to detect any abnormal operation very rapidly and very accurately. In particular, it is possible to detect when a spring breaks, whether there is an internal or an external leak, whether there are bad inlet conditions (cavitation, air or gas absorption, . . . ), etc.

We claim:

1. A method determining the flow rate delivered by a positive displacement pump in operation, the pump having at least one piston driven with a reciprocating motion in a chamber, which chamber is connected to a feed circuit for fluid to be pumped via an inlet valve and to an outlet circuit via a delivery valve, said valves being mechanically independent of the piston, the method comprising:

(a) counting the number of cycles performed by the pump in unit time;

(b) determining a corrected volume of the pump by:

(i) measuring the partial volumes of the chamber swept by the piston between an instant at which the piston passes through its end position of maximum engagement in the chamber and a closure instant of the delivery valve, and also between an instant at which the piston passes through its opposite end position and an opening instant of the delivery valve;

(ii) subtracting the two partial volumes from the volume swept by the piston; and (c) multiplying the number of cycles per unit time by the corrected volume of the pump so as to provide the flow rate.

2. A method according to claim 1, characterized by the fact that the instants at which the piston passes through its end positions are determined by measuring the varying position of the piston as a function of time.

3. A method according to claim 1, characterized by the fact that the instants at which the piston passes through its end positions are determined as being equidistant between the consecutive instants at which the piston passes a predetermined position.

4. A method according to claim 1 characterized by the fact that the closure instants of the delivery valve are determined by detecting the shocks produced by the valve closing against a delivery valve seat.

5. A method according to claim 1 characterized by the fact that the closure and/or opening instants of the delivery valve are determined by accoustically detecting the noise of fluid escaping between the valve and a delivery valve seat.

6. A method according to claim 1 characterized by the fact that the closure and/or opening instants of the delivery valve are determined by measuring their positions which vary as a function of time relative to a delivery valve seat.

7. A method according to claim 1 characterized by the fact that the closure and/or opening instants of the delivery valve are determined by measuring the internal pressure in the chamber which varies as a function of time.

8. A method of determining the flow rate delivered by a positive displacement pump in operation, the pump having at least one piston driven with a reciprocating motion in a chamber, which chamber is connected to a feed circuit for fluid to be pumped via an inlet valve and to an outlet circuit via a delivery valve, said valves being mechanically independent of the piston, the method comprising:

(a) counting the number of cycles performed by the pump in unit time;

(b) determining a corrected volume of the pump, by:

(i) sensing the position of the piston and at least one of the valves as a function of time, and determining at least the time differences between the instant at which at least one of the valves closes and/or opens and the passages of the piston through its end positions;

(ii) ascertaining from the time differences, partial volumes of the chamber swept by the piston during such time differences; and (iii) subtracting the partial volumes from the volume of the chamber;

(c) multiplying the number of cycles per unit time by the corrected volume of the pump so as to provide the flow rate.

9. A method according to claim 8 characterized by the fact that the closure and/or opening instants of the valve are determined by measuring the pressure in the inlet and/or outlet circuits and/or in the chamber which vary as a function of time.

* * * * *